United States Patent [19]

Gajjar

[11] Patent Number: 4,649,722

[45] Date of Patent: Mar. 17, 1987

[54] OPEN WARP KNIT FABRIC

[75] Inventor: Bharat J. Gajjar, Wilmington, Del.

[73] Assignee: E. I. Du Pont de Nemours and Company, Wilmington, Del.

[21] Appl. No.: 844,196

[22] Filed: Mar. 26, 1986

[51] Int. Cl.[4] ..... D04B 21/00

[52] U.S. Cl. ..... 66/195; 66/202

[58] Field of Search ..... 66/195, 193, 202

[56] References Cited

U.S. PATENT DOCUMENTS 3,931,721 1/1976 Adamson ..... 66/195

4,307,587 12/1981 Baesgen et al. ..... 66/202

OTHER PUBLICATIONS

*Research Disclosure,* Article 24338, Jul., 1984.

*Primary Examiner*—Ronald Feldbaum

[57] ABSTRACT

Open warp knit technology is applied to a fabric having nonelastomeric yarn on the front bar and elastomeric yarn on the back bar to reduce the number of pinch points between the yarns of the fabric and improve its recovery property. The nonelastomeric yarn is knit in an open stitch construction and the elastomeric yarn is knit in a closed stitch construction.

10 Claims, 11 Drawing Figures

JERSEY
(PRIOR ART)

0-1, 2-3, 5-4, 3-2 // 1-2, 1-0

0-2, 4-2 // 1-2, 1-0

0-1, 2-3, 5-4, 3-2 // 1-0, 1-2

FIG. 2A
(PRIOR ART)
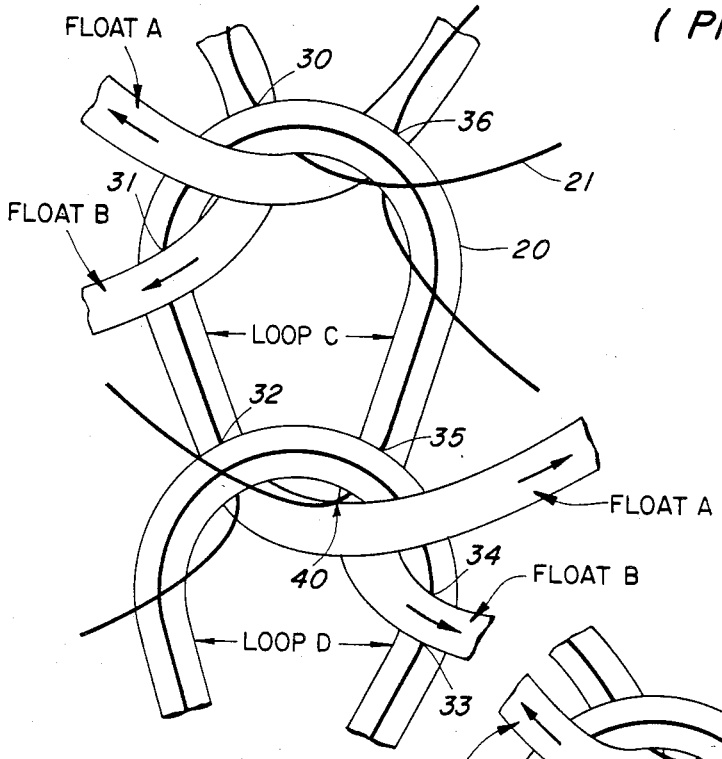
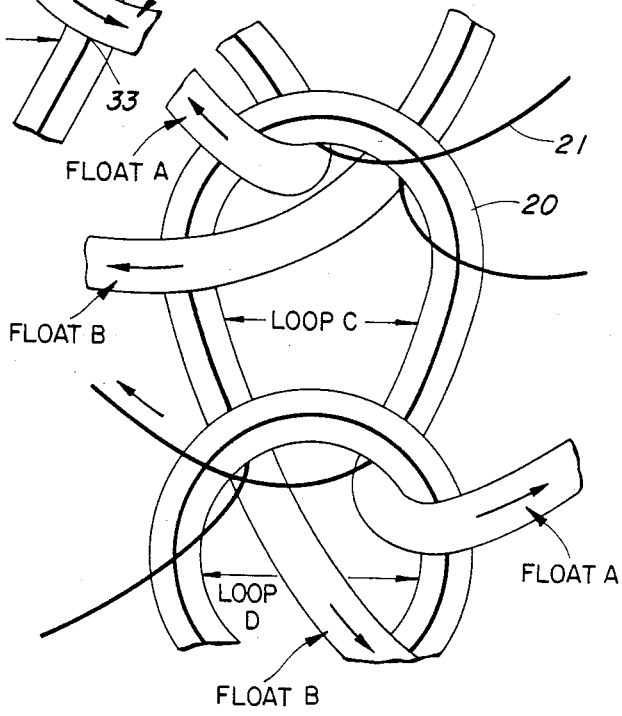
FIG. 2B

OPEN WARP KNIT FABRIC

BACKGROUND OF THE INVENTION

Field of the Invention

This invention relates to warp knitted fabrics, and more particularly to warp knitted fabrics having a nonelastomeric yarn knit in an open stitch construction in the front bar and an elastomeric yarn knit in a closed stitch construction in the back bar.

Open warp knit technology which incorporates open loops or a combination of open and closed loops in the stitch formation is disclosed in *Research Disclosure,* Article No. 24338, July 1984. The stated advantages were high luster, silk-like aesthetics and crepe-like frosty visual appearance. It has now been discovered that using this technology with elastomeric yarns in combination with nonelastomeric yarns provides a warp knit structure that imparts greater resistance to distortion and growth compared to conventional elastomeric/nonelastomeric Jersey warp knit structure which uses closed stitch construction exclusively in commercial fabrics.

SUMMARY OF THE INVENTION

This invention provides a warp knitted fabric that includes at least two sets of threads either, partial or full sets, knitted in courses according to a stitch pattern forming spaced wales of knitted loops. The improvement comprises back bar threads of elastomeric, such as spandex, yarn with a (1-0, 1-2 or 1-2, 1-0, or 2-4, 0-2, or 3-6, 3-0) stitch pattern and front bar threads of nonelastomeric, such as nylon, yarn knit with a (3-2, 0-1 or 0-1, 3-2 or 0-1, 2-3, 5-4, 3-2 or 0-2, 4-2 or 0-3, 6-3) stitch pattern. Double and triple needle stitches should use partial threading (e.g., 0-2, 4-2, and 0-3, 6-3 use guide bar threading, one end in and one end out; and one end in and two ends out, respectively).

This novel fabric construction eliminates crossover points, or pinch points between the elastomeric and nonelastomeric yarns, thus giving the elastomeric yarns more freedom to move which is not possible when the elastomeric yarns are pinched between the nonelastomeric yarns as with the prior art warp knit fabrics of elastomeric and nonelastomeric yarns.

BRIEF DESCRIPTION OF THE DRAWINGS

FIG. 2A is a loop diagram of a portion of the knitted loops of the prior art fabric shown in FIG. 1A.

FIG. 2B is a loop diagram of a portion of the knitted loops of a fabric of this invention shown in FIG. 1E.

DETAILED DESCRIPTION OF THE ILLUSTRATED EMBODIMENTS

Figure 1A:
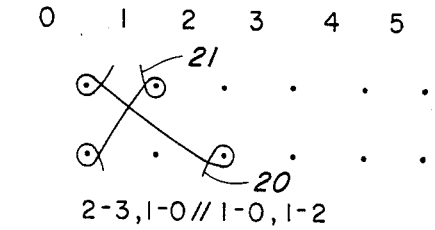
FIG. 1A is a stitch pattern diagram of a prior art warp knit fabric.
Figure 1B:
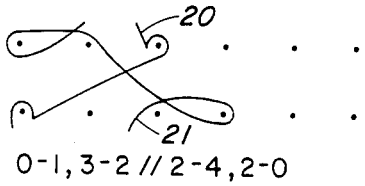
FIGS. 1B–1I are stitch pattern diagrams for the fabrics of this invention.
Figure 1C:
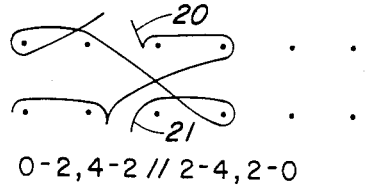
Figure 1D:
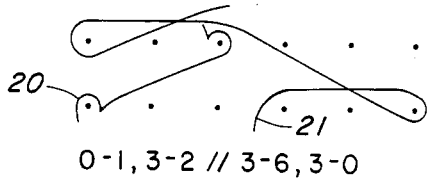

The invention is best defined in terms of stitch patterns as shown in FIGS. 1B to 1I. FIG. 1A being noted as prior art for warp knit fabrics of elastomeric combined with nonelastomeric yarns. For each of the Figs. represented a single needle-bar is normally employed, being fed from a front bar of nonelastomeric knitting yarns such as nylon yarn designated 20 and a back bar of elastomeric knitting yarns such as spandex yarn designated 21. Knitting needle positions for each of two successive courses are represented in the diagrams by horizontal lines of dots, the top line representing the course formed immediately after the course represented by the bottom line. Only one front-bar end and one back-bar end are shown in each instance, it being understood that one end of each is knitted on each knitting needle for every course. More particularly, referring to FIG. 1A, the stitch construction of the fabric is notationally set out and shows that the threads of the front bar, one of which is indicated at 20, have back and forth movement to nonadjacent needles in successive courses as indicated by the numbers 2-3, 1-0 and that the threads of the back bar, one of which is indicated as 21, having similar movements as indicated by the numbers 1-0, 1-2.

The back bar threads of elastomeric yarn 21 are closed loops while the front bar threads of nonelastomeric yarn 20 are open loops in the stitch constructions of the instant invention as depicted in FIGS. 1B through 1I. The movements to needles to excessive courses are indicated below each diagram by their numbers as set forth in Table I below.

TABLE I

| FIG. No. | Front Bar | Back Bar |
|---|---|---|
| 1A | 2-3, 1-0 | 1-0, 1-2 |
| 1B | 0-1, 3-2 | 2-4, 2-0 |
| 1C | 0-2, 4-2 | 2-4, 2-0 |
| 1D | 0-1, 3-2 | 3-6, 3-0 |
| 1E | 3-2, 0-1 | 1-0, 1-2 |
| 1F | 0-3, 6-3 | 1-2, 1-0 |
| 1G | 0-1, 2-3, 5-4, 3-2 | 1-2, 1-0 |
| 1H | 0-2, 4-2 | 1-2, 1-0 |
| 1I | 0-1, 2-3, 5-4, 3-2 | 1-0, 1-2 |

Figure 1E:
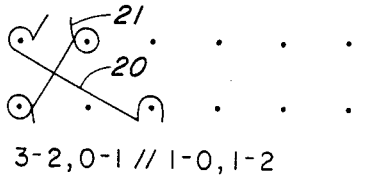
Figure 1F:
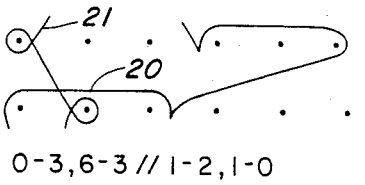
Figure 1G:
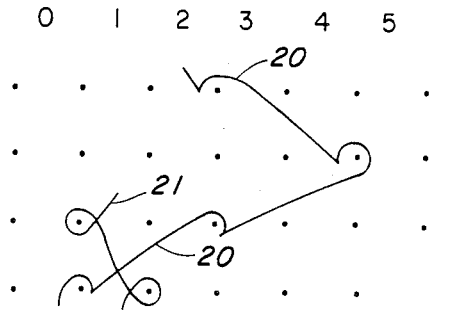
Figure 1H:
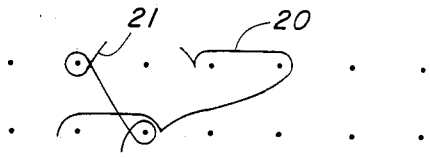
Figure 1I:
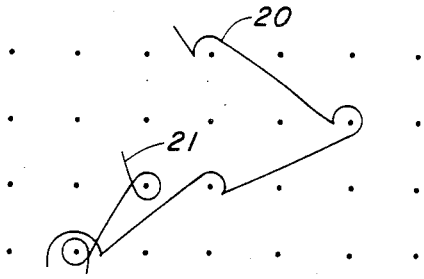

To illustrate the structure and functional advantage of this invention versus the prior art Jersey warp knit construction loop diagrams of FIG. 1A and FIG. 1E have been constructed as FIGS. 2A and 2B, respectively. Referring now to FIGS. 2A and 2B the nonelastomeric yarn is again designated 20 and the elastomeric yarn is designated 21. As illustrated in these figures float A of the nonelastomeric yarn 21 pulls generally upward and float B of this yarn pulls generally downward as indicated by the direction arrows. These floats in conjunction with the designated loop of nonelastomeric yarn sandwich the elastomeric yarn 21 between the two nonelastomeric yarns at locations or crossing points designated 30 through 36. At location 40 the float loops pinch the elastomeric yarn against the top of loop D in FIG. 2A by comparison while eight crossing points 30 through 36 are retained in the stitch construction of this invention. The pinch point is eliminated to provide more freedom for the elastomeric yarns to move in the fabric of this invention.

EXAMPLE

A 28-gauge tricot knitting machine is used to produce three fabrics as identified in Table II. The control fabric has the knit structure of the prior art as shown in FIG. 1A. The finishing procedures for the fabrics are outlined in Table III. The test methods for determining thickness, bulk, static extension, air permeability and power are detailed below.

Test Methods

Thickness is measured according to ASTM D1777-64 using apparatus commercially available from Customer Scientific Instruments, Inc., Whippany, NJ. Thickness is measured in inches.

Bulk (specific volume) is calculated according to the formula:

$$\text{Bulk } (cm^3/g) = \frac{2.54 \times 8361 \times T}{28.35\ W}$$

wherein

T = Thickness (inches)

W = Weight ($g/cm^2$)

Static Extension Test determines fabric elongation and growth. Measurements are made using a Model C5138 static extension tester available form Customer Scientific Instrument Co., Kearny, NJ.

Test Stretch is the length of a fabric sample while under a load of 2 lb. per inch fabric width expressed as a percentage of original relaxed length.

Growth is measured by holding a fabric sample at 180% of its relaxed length for two hours, then measuring its relaxed length after one minute and again after one hour. Growth is expressed as percentages of original relaxed fabric length.

Air Permeability is the rate of air flow though the fabric under a differential pressure between the two fabric surfaces and expressed in cubic feet of air per minute per square foot of fabric. It is measured in accordance with ASTM method D737-75.

I claim:

1. In a warp knitted fabric that includes at least two sets of threads knitted in courses according to a stitch pattern forming spaced wales of knitted loops, wherein the front bar incorporates an open loop stitch pattern and the back bar incorporates a closed loop stitch pattern the improvement comprising: back bar threads of elastomeric yarn knit with a (1-0, 1-2) stitch pattern and front bar threads of nonelastomeric yarn knit with a (0-1, 2-3, 5-4, 3-2) stitch pattern.

2. In a warp knitted fabric that includes at least two sets of threads knitted in courses according to a stitch pattern forming spaced wales of knitted loops, wherein the front bar incorporates an open loop stitch pattern and the back bar incorporates a closed loop stitch pattern the improvement comprising: back bar threads of elastomeric yarn knit with a (1-2, 1-0) stitch pattern and front bar threads of nonelastomeric yarn knit with a (0-2, 4-2) stitch pattern.

3. In a warp knitted fabric that includes at least two sets of threads knitted in courses according to a stitch pattern forming spaced wales of knitted loops, wherein the front bar incorporates an open loop stitch pattern and the back bar incorporates a closed loop stitch pattern the improvement comprising: back bar threads of elastomeric yarn knit with a (1-2, 1-0) stitch pattern and front bar threads of nonelastomeric yarn knit with a (0-3, 6-3) stitch pattern.

4. In a warp knitted fabric that includes at least two sets of threads knitted in courses according to a stitch pattern forming spaced wales of knitted loops, wherein the front bar incorporates an open loop stitch pattern and the back bar incorporates a closed loop stitch pattern the improvement comprising: back bar threads of elastomeric yarn knit with a (2-4, 2-0) stitch pattern and

TABLE II

FABRIC CONSTRUCTION AND GREIGE FABRIC PROPERTIES

| Fabric Number | Type Fabrics | Front Bar//Back Bar | Stitch-F.B//B.B. |
|---|---|---|---|
| 4955-68A | Jersey (Control) | 40-13 T865 Nylon//40 den Spandex | 2-3, 1-0//1-0, 1-2 |
| 4955-68C | Del-Jersey | 40-13 T865 Nylon//40 den Spandex | 3-2, 0-1//1-0, 1-2 |
| 4955-68I | Del-Atlas | 40-13 T865 Nylon//40 den Spandex | 0-1, 2-3, 5-4, 3-2//1-0, 1-2 |

| Fabric Number | Guide Bar Threading F.B.//B.B. | Gauge | Knit Quality | Runners - Inch F.B.//B.B. | Lycra\Tension gms/3 ends |
|---|---|---|---|---|---|
| 4955-68A | full//full | 28 | 7.5" | 58"//24" | 8½ |
| 4955-68C | full//full | 28 | 7.5" | 60"//24" | 8¾ |
| 4955-68I | full//full | 28 | 7.5" | 60⅜"//24 | 7¾ |

| Fabric Number | Greige Fabric Weight oz/yd | Count WPI | Count CPI | Hand Stretch % Wale | Hand Stretch % Course | Boiled Off Fabric Weight oz/yd² |
|---|---|---|---|---|---|---|
| 4955-68A | 5.5 | 64 | 100 | 150 | 100 | 7.8 |
| 4955-68C | 5.3 | 64 | 96 | 130 | 100 | 8.2 |
| 4955-68I | 5.5 | 56 | 120 | 160 | 85 | 7.5 |

FINISHED FABRIC PROPERTIES

| Fabric Number | Weight oz/yd² | Count WPI × CPI | Thickness BSI | Bulk cc/g | Hand Stretch % Wale | Hand Stretch % Course |
|---|---|---|---|---|---|---|
| 4955-68A (Control) | 4.8 | 63 × 100 | .031 | 4.89 | 150 | 120 |
| 4955-68C | 4.7 | 65 × 94 | .032 | 5.10 | 150 | 100 |
| 4955-68I | 4.5 | 56 × 100 | .029 | 4.88 | 170 | 100 |

STATIC EXT. TEST

| Fabric Number | % Test Stretch Wale × Course | % Growth 1 Min. Wale × Course | % Growth 1 Hr. Wale × Course | Air Per. cu. ft. min/ft² |
|---|---|---|---|---|
| 4955-68A (Control) | 173 × 133 | 28 × 26 | 21 × 15 | 329 |
| 4955-68C | 170 × 143 | 20 × 24 | 14 × 15 | 417 |
| 4955-68I | 203 × 118 | 32 × 18 | 26 × 12 | 382 |

TABLE III

FINISHING PROCEDURE

| | |
|---|---|
| Step 1 | Steam the fabrics. |
| Step 2 | Heat set the fabrics on the Pin Tenter at 375° 4 boxes - 50 secs. 7% overfeed and 7% over with the greige fabric |
| Step 3 | Beck scour and dye the fabrics |
| Step 4 | Dry on the Pin Tenter at 290° F. 30 yds/min and set the Pin Tenter at the fabric's wet width. |

front bar threads of nonelastomeric yarn knit with a (0-1, 3-2) stitch pattern.

5. In a warp knitted fabric that includes at least two sets of threads knitted in courses according to a stitch pattern forming spaced wales of knitted loops, wherein the front bar incorporates an open loop stitch pattern and the back bar incorporates a closed loop stitch pattern the improvement comprising: back bar threads of elastomeric yarn knit with a (1-2, 1-0) pattern and front bar threads of nonelastomeric yarn knit with a (0-1, 2-3, 5-4, 3-2) stitch pattern.

6. In a warp knitted fabric that includes at least two sets of threads knitted in courses according to a stitch pattern forming spaced wales of knitted loops, wherein the front bar incorporates an open loop stitch pattern and the back bar incorporates a closed loop stitch pattern the improvement comprising: back bar threads of elastomeric yarn knit with a (2-4, 2-0) stitch pattern and front bar threads of nonelastomeric yarn knit with a (0-2, 4-2) stitch pattern.

7. In a warp knitted fabric that includes at least two sets of threads knitted in courses according to a stitch pattern forming spaced wales of knitted loops, wherein the front bar incorporates an open loop stitch pattern and the back bar incorporates a closed loop stitch pattern the improvement comprising: back bar threads of elastomeric yarn knit with a (3-6, 3-0) stitch pattern and front bar threads of nonelastomeric yarn knit with a (0-1, 3-2) stitch pattern.

8. In a warp knitted fabric that includes at least two sets of threads knitted in courses according to a stitch pattern forming spaced wales of knitted loops, wherein the front bar incorporates an open loop stitch pattern and the back bar incorporates a closed loop stitch pattern the improvement comprising: back bar threads of elastomeric yarn knit with a (1-0, 1-2) stitch pattern and front bar threads of nonelastomeric yarn knit with a (3-2, 0-1) stitch pattern.

9. In a warp knitted fabric that includes at least two sets of threads knitted in courses according to a stitch pattern forming spaced wales of knitted loops, wherein the front bar incorporates an open loop stitch pattern and the back bar incorporates a closed loop stitch pattern the improvement comprising: back bar threads of elastomeric yarn knit with a (3-0, 3-6) stitch pattern and front bar threads of nonelastomeric yarn knit with a (3-2, 0-1) stitch pattern.

10. A fabric as in any of the preceding claims in which said front bar threads are nylon, said back bar threads are spandex.

* * * * *